United States Patent [19]

Ota

[11] 3,982,298

[45] Sept. 28, 1976

[54] MITT TYPE SHOE CLEANER

[76] Inventor: Tunezo Ota, 10-21 Koshien-cho, Nishinomiya, Hyogo, Japan

[22] Filed: Sept. 24, 1975

[21] Appl. No.: 616,499

[52] U.S. Cl. ..... 15/106; 15/114; 15/227; 2/158; 2/167

[51] Int. Cl.[2] ..... A41D 19/01; A47L 23/10

[58] Field of Search ..... 15/106, 107, 114, 160, 15/227; 2/158, 167, 168; 401/7

[56] References Cited

UNITED STATES PATENTS

| | | | |
|---|---|---|---|
| 671,296 | 4/1901 | Rowand | 15/227 X |
| 731,583 | 6/1903 | Love | 15/107 |
| 1,139,283 | 5/1915 | Hepner | 15/227 |
| 1,357,006 | 10/1920 | Schloss | 2/158 UX |

FOREIGN PATENTS OR APPLICATIONS

| | | | |
|---|---|---|---|
| 192,125 | 11/1907 | Germany | 15/227 |
| 18,426 | 8/1975 | Japan | 15/227 |
| 3,590 | 4/1909 | United Kingdom | 15/227 |
| 858,087 | 1/1961 | United Kingdom | 15/227 |

*Primary Examiner*—Daniel Blum

[57] ABSTRACT

A mitt type shoe cleaner having first and second brushes secured to non-expandable flexible thumb and finger receiving sections, respectively. The said sections are secured together by a central section made from elastic material so that the mitt may accommodate various sizes of hands.

8 Claims, 2 Drawing Figures

MITT TYPE SHOE CLEANER

Figure 1:
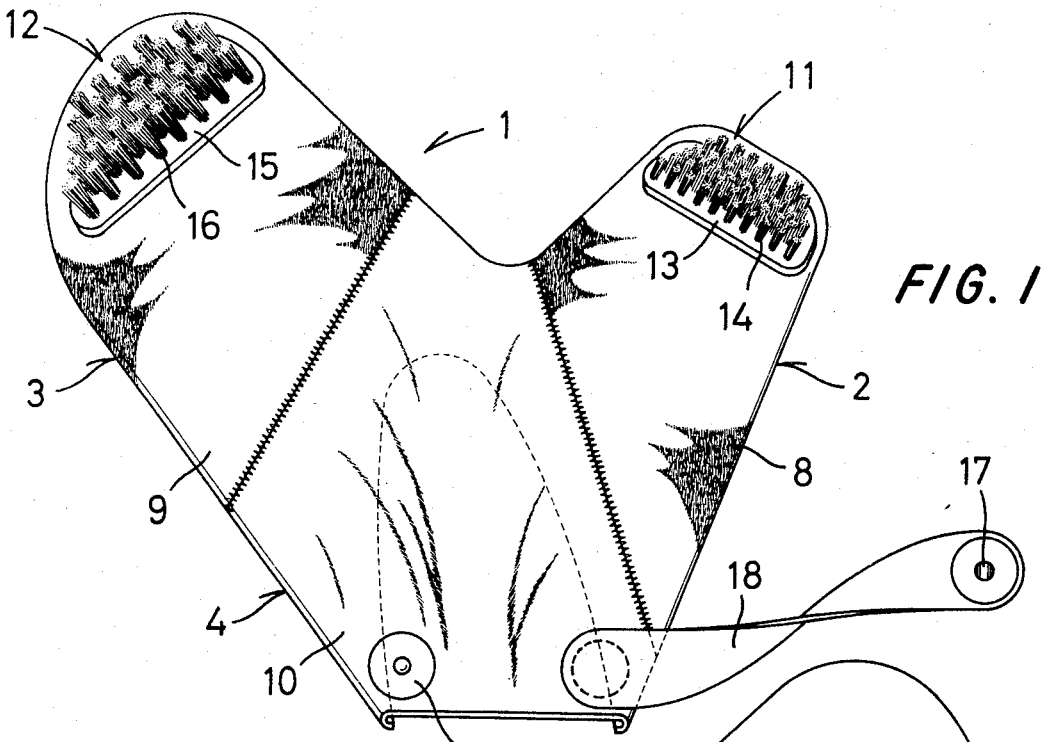

The present invention relates to a shoe cleaner, more particularly, to a shoe cleaner which is put on a hand like a glove when it is used, and is folded into a small size to enable to carry it after use.

A prior shoe cleaner of the type to which the present invention is concerned, is disclosed in Japanese Pat. No. 18426/75.

The shoe cleaner as disclosed in the Japanese Pat. No. 18426/75 comprises a body comprising a first hollow portion into which the thumb is to be inserted, a second hollow portion into which the remaining four fingers are to be inserted and a central portion connecting said first and second portions together. On the tip portion of the front side of said first and second portions, there are attached first and second brushes, respectively, for brushing the shoes. The said first and second hollow portions have substantially same shape and size, and the entire body is formed of nonexpandable fabric.

Such shoe cleaner may be folded into small size after use so that it can be easily carried by putting it into pocket of trousers or jacket, or into a bag. Furthermore, this shoe cleaner makes it unnecessary to prepare the brush and the polishing cloth separately.

However, this shoe cleaner have several drawbacks.

In the first place, the said first hollow portion is too large for the thumb, and therefore, the said first brush as attached to the tip portions of said first hollow portion of the body can not be well controlled or handled by the thumb to brush the shoes.

In the second place, since the entire body is formed of non-expandable fabric, the shoe cleaner does not well fit to various sizes of hands. For instance, if the hand is very large, it is difficult or impossible to even insert the hand into the shoe cleaner.

In view of the drawbacks of the prior shoes cleaner as described above, it is a main object of the present invention to provide a shoe cleaner in which the brush as attached to said first hollow portion of the body could be easily controlled or handled by the thumb with steadiness.

Another object of the present invention is to provide a shoe cleaner which well fits to various sizes of hands.

A further object of the present invention is to provide a shoe cleaner which is able to effectively brush various parts of shoes.

In order to accomplish the objects as described above, according to the present invention, there is provided a shoe cleaner comprising a body which, in turn, comprises a relatively small first hollow portion into which the thumb is to be inserted, a relatively large second hollow portion into which the remaining four fingers are to be inserted, and a central portion located between and connecting said first and second hollow portions together at the front side of the body; a first brush attached to the tip portion of said first hollow portion at the front side thereof; and a second brush attached to the tip portion of said second hollow portion at the front side thereof; said first and second hollow portions being formed of a flexible material, and said central portion being formed of an expandable flexible material.

According to a preferred feature of the present invention, the front side of said first and second hollow portions of the body are formed of polishing cloth such as velvet or corduroy.

According to another preferred feature of the present invention, said central portion of the body is formed of spandex or rubber cloth.

According to further preferred feature of the present invention, a base plate of said first brush as attached to the tip portion of said first hollow portion and supporting bristles thereon is made of soft elastic material.

According to still further preferred feature of the present invention, a base plate of said second brush as attached to the tip portion of said second hollow portion and supporting bristles thereon is made of hard material.

Figure 2:
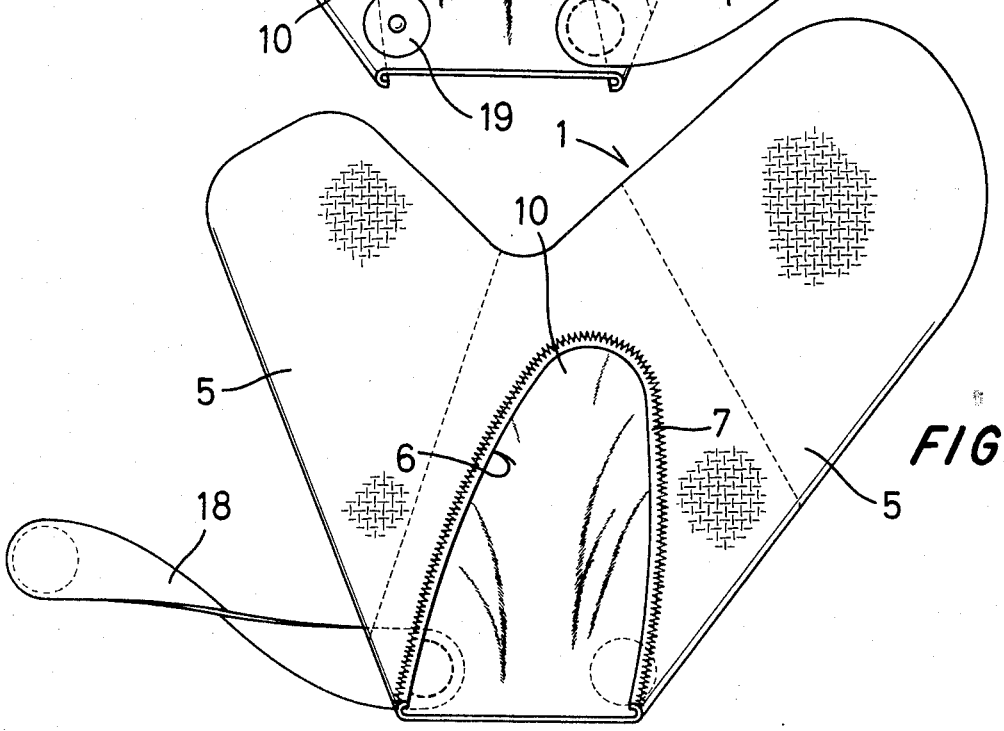

These and other objects and features of this invention will be better understood upon consideration of the following detailed description and the accompanying drawings in which:

FIG. 1 is a front side view of an embodiment of a shoe cleaner according to the present invention; and FIG. 2 is a back side view of the embodiment of FIG. 1.

Now referring to the drawings, the reference numeral 1 designates a body comprising a relatively small first hollow portion 2 into which the thumb is to be inserted, a relatively large second hollow portion 3 into which the remaining four fingers are to be inserted, and a central portion 4 located betwen and connecting said first and second hollow portions 2 and 3 together at the front side, i.e. at the side of the palm of the hand, of the body 1.

The said first hollow portion 2 is relatively small so that the thumb could be inserted thereinto snugly but easily. The said second hollow portion 3 is relatively large so that the remaining four fingers could be also snugly but easily inserted thereinto.

The back of the body 1 is formed of a strong flexible sheet material 5 and the portion of the sheet material which is opposed to said central portion 4 is provided with an opening 6 for the insertion of the hand. A rubber band or string 7 is secured to the sheet material 5 along the edge portion of said opening 6 by any suitable means.

The front side portion of said first and second hollow portions 2 and 3 of the body 1 is respectively constituted by a polishing cloth 8 and 9 such as velvet or corduroy. The central portion 4 is constituted by an expandable or elastic flexible sheet material 10 such as spandex or rubber cloth.

Here it should be noted that the "rubber cloth" comprises any combination of cloth layer and rubber layer. For instance, it may be a cloth one side of which is coated with rubber, or may be a laminate comprising a rubber layer and cloth layers on the opposite sides thereof. When such rubber cloth is used for the central portion 4, it is preferred to place the cloth layer outside.

At the front side of the body 1, there is attached a first brush 11 to the tip portion of said first hollow 2, while to the tip portion of said second hollow portion 3, there is attached a second brush 12. Said first brush 11 comprises a base plate 13 of soft elastic material such as elastic plastic and bristles 14 supported on one side of the base plate 13. The other side of the base plate 13 is attached to said first hollow portion 2 by any suitable means such as an adhesive. The length of the bristle 14 is relatively short and is preferably approximately 0.5 cm. On the other hand, a base plate 15 of the brush 12 is made of substantially inflexible hard material such as hard plastic and the bristles 16 supported on one side of the base plate 15 is relatively long and is preferably approximately 1 cm length.

On said central portion 4, there is secured one end of an expandable band 18 to the rightward lower portion of the portion 4 as viewed in FIG. 1, and a female snap 17 is secured to the other end of the band 18. To said central portion 4, there is also secured a male snap 19 at the leftward lower portion of the central portion 4.

When the shoe cleaner as described above is used, the hand is inserted into the glove shaped body 1 through the opening 6 provided in the back, and thumb is inserted into said first hollow portion 2 and the remaining four fingers are inserted into said second hollow portion 3. Thereafter, the band 18 is placed around the wrist and the female snap 17 is engaged with the male snap 19 to thereby securely hold the shoe cleaner on the hand. In this time, the rubber band or string 7 also serves to resiliently hold the shoe cleaner on the hand.

As already described above, the said first hollow portion 2 is relatively small so as to receive the thumb snugly, and the said second hollow portion 3 is relatively large so as to receive the remaining four fingers snugly. Thus, the entire hand is well fitted into the shoe cleaner and the said first brush 11 as attached to said first hollow portion 2 can be easily controlled or handled by the thumb with steadiness. Furthermore, since the central portion 4 is formed of expandable or elastic sheet material 10 such as rubber cloth, substantially any size of hand can be inserted into the body 1.

After the hand has been inserted into the shoe cleaner, the dust on the shoe surface is removed by means of said second brush 12, and thereafter the shoe polish is applied on the shoe surface. Then the shoe is brushed by means of said first and second brushes 11 and 12. At this time, the joint between the upper and the sole is easily and better brushed by means of the second brush 12 having longer bristles 16, and the upper is easily and better brushed by means of the first brush 11 having soft elastic base plate 13.

After the shoe has been brushed as described above, it is roughly polished by the central portion 4 of the body 1, and thereafter, finished by the polishing cloth 8 and 9 of the first and second hollow portions 2 and 3, respectively.

The shoe cleaner, after use, is folded so that the first brush 11 on the first hollow portion 2 and the second brush 12 on the second hollow portion 3 are opposed to each other, and the band 18 is wrapped around such folded body 1 and the snap 17 is engaged with the other snap 19 to hold the shoe cleaner in the folded state.

While an embodiment of the present invention has been illustrated and described in detail, it is particularly understood that the invention is not limited thereto or thereby.

What is claimed is:

1. A mitt type shoe cleaner comprising in combination, a body comprising a relatively small first hollow portion into which the thumb is to be inserted, a relatively large second hollow portion into which the remaining four fingers are to be inserted, and a separate central portion located between and connecting said first and second hollow portions together at the front side of the body;

a first brush attached to the tip portion of said first hollow portion at the front side thereof; and, a second brush attached to the tip portion of said second hollow portion at the front side thereof;

said first and second hollow portions being formed of a non-elastic flexible material, and said central portion being formed of an elastic flexible sheet material.

2. A shoe cleaner as claimed in claim 1, wherein the front side of said first and second hollow portions of the body are formed of velvet.

3. A shoe cleaner as claimed in claim 1, wherein the front side of said first and second hollow portions of the body are formed of corduroy.

4. A shoe cleaner as claimed in claim 1, wherein said central portion of the body is formed of spandex.

5. A shoe cleaner as claimed in claim 1, wherein the central portion of the body is formed of rubber cloth.

6. A shoe cleaner as claimed in claim 1, wherein said first brush as attached to the tip portion of said first hollow portion of the body comprises a base plate of soft elastic material having bristles on one side thereof and the other side of said base plate is attached to said first hollow portion.

7. A shoe cleaner as claimed in claim 6, wherein said second brush as attached to said second hollow portion of the body comprises a base plate of hard material having bristles on one side thereof and the other side of said base plate is attached to said second hollow portion.

8. A shoe cleaner as claimed in claim 7, wherein the bristles of said second brush are longer than those of said first brush.

* * * * *